US012441438B2

(12) United States Patent
Rosen

(10) Patent No.: US 12,441,438 B2
(45) Date of Patent: Oct. 14, 2025

(54) WATER SPORT DEVICE

(71) Applicant: ROSEN SWISS AG, Stans (CH)

(72) Inventor: Hermann Rosen, Kastanienbaum (CH)

(73) Assignee: ROSEN Swiss AG, Stans (CH)

( * ) Notice: Subject to any disclaimer, the term of this patent is extended or adjusted under 35 U.S.C. 154(b) by 735 days.

(21) Appl. No.: 17/755,553

(22) PCT Filed: Nov. 2, 2020

(86) PCT No.: PCT/EP2020/080696
§ 371 (c)(1),
(2) Date: May 2, 2022

(87) PCT Pub. No.: WO2021/084127
PCT Pub. Date: May 6, 2021

(65) Prior Publication Data

US 2022/0380000 A1 Dec. 1, 2022

(30) Foreign Application Priority Data

Nov. 1, 2019 (DE) ..... 102019129573.4

(51) Int. Cl.

| | |
|---|---|
| ***B63B 1/24*** | (2020.01) |
| ***B63B 1/30*** | (2006.01) |
| ***B63B 32/10*** | (2020.01) |
| ***B63B 32/64*** | (2020.01) |

(52) U.S. Cl.
CPC ..... *B63B 1/246* (2013.01); *B63B 1/30* (2013.01); *B63B 32/10* (2020.02); *B63B 32/64* (2020.02)

(58) Field of Classification Search
CPC .. B63B 1/00; B63B 1/246; B63B 1/30; B63B 32/00; B63B 32/10; B63B 32/64; B63B 1/24; B63B 1/28; B63B 1/286; B63B 35/00; B63B 35/79
USPC ..... 114/274
See application file for complete search history.

(56) References Cited

U.S. PATENT DOCUMENTS

| | | | | |
|---|---|---|---|---|
| 2,749,870 | A | 6/1956 | Vavra | |
| 3,183,871 | A | 5/1965 | Reder | |
| 3,207,119 | A | 9/1965 | Holder | |
| 5,722,864 | A | 3/1998 | Andiarena | |
| 10,099,754 | B2 * | 10/2018 | Tian | B63B 32/10 |

(Continued)

FOREIGN PATENT DOCUMENTS

| | | | |
|---|---|---|---|
| CN | 204998276 | U | 1/2016 |
| CN | 108945334 | A | 12/2018 |

(Continued)

*Primary Examiner* — Lars A Olson
(74) *Attorney, Agent, or Firm* — Husch Blackwell LLP

(57) ABSTRACT

A water sports apparatus is provided, and includes a propulsion device which is provided for the propulsion of the water sports apparatus and whose motor, arranged on the float-body side, is connected in terms of drive to at least one propulsion element via an angularly and/or longitudinally movable propulsion train. The angularly and/or longitudinally movable propulsion train allows the propulsion element to be positioned optimally on the body-of-water side. The motor is arranged in a region which does not cause any body-of-water-side resistance in the operating position with a float body lifted off from the water surface. That part of the water sports apparatus which is situated in the water is optimized with regard to the design which is relevant to flow resistance in the water.

13 Claims, 9 Drawing Sheets

(56) References Cited

U.S. PATENT DOCUMENTS

| | | | | |
|---|---|---|---|---|
| 10,308,336 | B1 | 6/2019 | Vermeulen | |
| 10,597,118 | B2 * | 3/2020 | Montague | B63B 32/10 |
| 2014/0134900 | A1 | 5/2014 | Derrah | |
| 2017/0349246 | A1 | 12/2017 | Tian | |
| 2018/0072383 | A1 | 3/2018 | Montague et al. | |
| 2019/0135378 | A1 | 5/2019 | Tian | |

FOREIGN PATENT DOCUMENTS

| | | | | | |
|---|---|---|---|---|---|
| CN | 208715431 | U | | 4/2019 | |
| CN | 208760860 | U | | 4/2019 | |
| CN | 109976226 | A | | 7/2019 | |
| DE | 202011051071 | U1 | | 11/2011 | |
| DE | 102014005314 | A1 | | 10/2015 | |
| DE | 102015103553 | A1 | | 9/2016 | |
| EP | 529564 | A1 | | 3/1993 | |
| EP | 2548797 | A1 | * | 1/2013 | B63H 25/42 |
| EP | 3214521 | A1 | | 9/2017 | |
| EP | 3581482 | A1 | | 12/2019 | |
| FR | 2746763 | A1 | * | 10/1997 | B63B 1/22 |
| WO | 2018147386 | A1 | | 8/2018 | |
| WO | 2019063749 | A1 | | 4/2019 | |

* cited by examiner

WATER SPORT DEVICE

CROSS REFERENCE

This application claims priority to PCT Application No. PCT/EP2020/080696, filed Nov. 2, 2020, which itself claims priority to German Patent Application No. 10 2019 129573.4, filed Nov. 1, 2019, the entirety of both of which are hereby incorporated by reference.

FIELD OF THE INVENTION

The present invention relates to a water sports apparatus, in particular a foilboard, having a float body, preferably in the form of a float board, and having a foil device which is fastened to the float body by means of a holding device, wherein the foil device, which is arranged on a link of the holding device, has at least one, preferably at least two, foils and, via the holding device, can be transferred from a rest and/or starting position into an operating position below the float body, wherein, in the operating position and during a forward movement, on account of lift generated by the foil device, the float body can be transferred into a position in which it is spaced apart from a water surface.

Such water sports apparatuses generally serve for moving persons over water, who for this purpose situate themselves on that side of the float body which faces away from the foil device. During the movement, the foil device is generally arranged below the water surface.

BACKGROUND OF THE INVENTION

DE 10 2015 103 553 A1 has disclosed a water sports apparatus having a foil device (which can also be referred to as foil) that can fold in counter to the riding direction in the event of underwater contact so as to avoid damage. Once folded-in, riding is no longer possible. Furthermore, US 2018/0072383 A1 has disclosed a foil device which can be transferred from a first operating position into a further operating position by way of an adjustable angle of the connecting strut between float body and propulsion device. As a result of the propulsion device situated underwater, the device is of relatively deep construction and the flow resistance is relatively high. Both prior-art water sports apparatuses require a sufficiently deep body of water for their use, since otherwise the foil device will touch the bed and be either damaged or folded in.

BRIEF SUMMARY OF THE INVENTION

It is an object of the invention to provide a water sports apparatus which can be operated with high performance at least in deep water, in particular also in shallow water.

According to the invention, the water sports apparatus has a propulsion device which is provided for the propulsion of the water sports apparatus and whose motor, arranged on the float-body side, is connected in terms of drive to at least one propulsion element via an angularly and/or longitudinally movable propulsion train. The angularly and/or longitudinally movable propulsion train allows the propulsion element to be positioned optimally on the body-of-water side. At the same time, the motor is arranged in a region which does not cause any body-of-water-side resistance in the operating position with a float body lifted off from the water surface. That part of the water sports apparatus (preferably in the form of a foilboard) which is situated in the water is optimized with regard to the design which is relevant to flow resistance in the water.

The float body is in particular a flat, elongate body whose density is significantly below that of water. The float body is in particular designed in such a way that, during operation, it is at any rate arranged partially above the water surface, preferably independently of a riding speed. During operation, the holding device extends from the float body to the foil device below the float body. Lift generated by the foil device is transmitted to the float body by way of the holding device, which float body, along with the person situated thereon, lifts off from the water surface with sufficient lift. Float-body side means an arrangement in or on the float body, specifically in particular one such that the motor, at least in an operating position with float body spaced apart from the water surface, is likewise spaced apart from the water surface.

A design of the water sports apparatus in the case of which, both in a rest and/or starting position of the foil device close to the float body and in an operating position remote therefrom, the propulsion element is connected in terms of drive to the motor and can be driven by the latter is particularly advantageous. In this way, a water sports apparatus according to the invention can be operated both in shallow water, in particular water with a depth of approximately 50 cm, and in deep water. For this purpose, the propulsion train or individual elements thereof may sweep over an angle of at least 40°, in particular of at least up to 90° or 100°.

The foil device, in the rest and/or starting position, is arranged closer to the float body than in the operating position for the benefit of greater compactness of the water sports apparatus. In particular, the holding device is folded in and/or retracted in order to transfer the foil device into the rest and/or starting position.

The at least one link is designed in particular as a rigid strut. In particular, the link is mounted so as to be pivotable relative to the float body and/or relative to the foil device. Alternatively or additionally, the at least one first link is mounted so as to be translationally movable, in particular displaceable, relative to the float body and/or relative to the foil device. The foil device is coupled to the first link in particular indirectly via further components, such as for example links, or directly. A link generally refers to a movably connected and in particular articulated, but otherwise rigid, linkage component in the form of a solid or hollow body, for example, which can be used, possibly in combination with one or more further links, to move parts of the water sports apparatus relative to one another. Preferably, the holding device has links which are pivotable in relation to one another and/or which are displaceable into or against one another and thus, for example, telescopable.

Particularly preferably, the holding device has at least one further link. In particular, the first link and the further link are arranged one behind the other in the riding direction at least in the operating position of the foil device. Alternatively or additionally, the first link and/or the second link are/is arranged pivotably in particular on the float body and/or on the foil device or a unit or receptacle connected rigidly thereto. In particular, it is thus the case that at least one of the links is arranged pivotably on a receptacle for the at least one foil device or on a receptacle of the foil device. Here, the pivot axes are oriented in particular transversely to the riding direction and, during operation, parallel to the water surface. In this way, the holding device can be designed as a parallelogram linkage, which is particularly reliable and by way of which the carrying device remains below the float body, in particular also in the rest and/or starting position.

Alternatively or additionally, the holding device preferably comprises further links, which are each coupled to one of the two links and, at least in the operating position, adjoin one another between the float body and the foil device and transmit force to one another. In particular, the two first or further links are pivotable in relation to one another, whereby a toggle-lever or folding mechanism can be produced as holding device. For example, in each case two links forming a knee joint are arranged one behind the other in the riding direction.

Alternatively or additionally, at least one of the two links is displaceable at least at one end relative to the float body or relative to the foil device. This makes possible the formation of a scissors mechanism for the transfer of the foil device. Alternatively or additionally, at least one of the links is mounted so as to be pivotable relative to the float body and/or relative to the foil device about a pivot axis which is parallel to the riding direction. In particular, the holding device comprises in total at least four links, which are coupled to one another in the manner of a scissor jack (the respectively oppositely situated links being at any rate arranged in a parallel manner). The above-described mechanical features of the holding device or of the links make it possible to provide particularly reliably handleable transfer mechanisms and thus water sports apparatuses.

Alternatively or additionally, the foil device has telescopable links which are mounted so as to be longitudinally displaceable into or against one another and via which the distance between the foil device and the float body can be varied.

The foil device is preferably provided, at least in the operating position, with at least one foil which is flat and preferably at least partially wing-shaped or fin-shaped. The width of the foil device, measured transversely to the riding direction, is in particular at most twice as large as the width of the float body. The foil device serves to stabilize riding with the water sports apparatus and to generate lift, wherein, to enhance these effects, the foil device preferably has lateral foil ends which are angled in relation to the substantially flat water surface. Preferably, for enhancing these effects, the water sports apparatus has a plurality of foils which are spaced apart from one another in the riding direction and/or are at different distances from the float body. The foil device thus comprises at least one foil and the holder thereof and possibly a propulsion device.

According to one refinement of the invention, the design of the propulsion train is improved if it extends through or along a link of the holding device. It is then possible for the propulsion train to be moved with protection by way of the link, and at least to be adapted easily in terms of design to the movement thereof. The propulsion train is capable of participating in or compensating for a relative movement between float body and foil device.

In particular, the propulsion element, which is preferably in the form of an impeller or propeller, is configured as part of the foil device and/or of the holding device and, as a part arranged thereon, is accordingly moved along via the movement thereof.

Preferably, the propulsion device has at least one shaftless and/or hubless propeller or impeller, in particular wherein the impeller is arranged at least partially in a flow channel of a propulsion body that is connected to the surroundings via at least two openings. In this way, the propulsion device is particularly suitable for operation close to the shore or beach, since the risk of injury is considerably reduced by the arrangement in a flow channel, on the one hand, and any growth of algae or the like gets caught in the flow channel, and in particular on the impeller, significantly less often, on the other hand.

In a variant configured for uniform transmission of the force generated by a motor and for running which is as far as possible free of vibration, the propulsion train comprises at least one constant-velocity joint, which forms for example a transition from a motor shaft to a propulsion train element extending along a link of the holding device.

Additionally, for example in the region of the foil device, or alternatively, the propulsion train may have at least one cardan joint, this frequently providing a structurally simpler and less expensive solution. It is also alternatively or additionally possible for the force to be transmitted via a belt drive comprising at least one belt as force-transmitting part.

Preferably, the propulsion train alternatively or additionally has at least one electromagnetic coupling and/or at least one bevel-gear set, which transmit(s) the force from the motor in the direction of a propulsion element, in particular a propeller.

Preferably, there is situated in the float body an energy store for the propulsion device, for example in the form of a liquid-fuel store for example marine diesel, gasoline or liquefied gas, or in the form of an accumulator. In particular in the case of a motor in the form of a liquefied-gas-fueled combustion engine, it is possible, with an energy store arranged in the float body so as to be sufficiently dimensionable, to achieve for a long time, in particular more than 1.5 hours, a sufficiently high performance through motor powers of up to 10 kW.

Preferably, the holding device has a drive which is provided with a further energy store or the energy store for the propulsion device and via which the foil device can be transferred from a rest and/or starting position into the operating position and/or from the operating position into the rest and/or starting position, in particular is retractable and extendable and/or foldable. The drive force may originate from the motor of the propulsion device, but may alternatively also originate from a separate, smaller drive motor, whereby the drive can be matched optimally to the force required for the movement, in particular pivoting, of the holding device with the carrying device arranged thereon. Preferably, the drive of the holding device is arranged at least partially, in particular completely, in a recess of the float body. In particular, the drive has a surface, or a cover having a surface, which fits into the surface of the float body. However, the surface is arranged in particular on the underside of the float body. Due to this arrangement of the drive, the water sports apparatus is streamline-optimized and even more compact and can be operated accordingly with less resistance and in relatively shallow water.

Preferably, the water sports apparatus, in particular the propulsion device, comprises at least one sensor, preferably a plurality of sensors, from a group comprising gyro sensors, speed sensors, position sensors (GPS, Glonass, BeiDou or the like), distance sensors, that is to say sensors for measuring the distance from objects or structures (in particular ultrasound, echo sounder, sonar), infrared sensors, and inclination sensors. Equipping the water sports apparatus with one or more such sensors makes possible the formation of an "intelligent" water sports apparatus, which not only makes its use more trackable through storing of the sensor data in a corresponding memory, but in particular makes it more convenient, simpler, and safer. For example, it is possible to use a position sensor for tracking the route, a speed sensor for adjusting the holding device and/or at least parts of the foil device, inclination sensors for balancing the water sports apparatus in an operating position, and infrared sensors for detecting persons present in the surroundings. The water sports apparatus can automatically make adjustments, for example to the riding speed, the height above the water surface, or the position of the holding device, in a manner dependent on the sensor data. The control unit is configured for processing the signals of the sensors, in particular for forming control signals, for one or more of these processes. It goes without saying that the control unit has corresponding data-processing means, operating-energy stores (in particular one or more batteries or liquid-energy stores), and communication means including a human-machine interface, for this purpose.

According to an advantageous embodiment of the invention, the control unit is configured for generating control signals on the basis of signals of the sensor arrangement for the purpose of geofencing. Geofencing means restriction of the region that is accessible to the water sports apparatus on the basis of navigation data. If it is ascertained in the control unit based on data for example from a position sensor that a predefinable region has been left or is about to be left, for example the drive power of a propulsion device can be reduced or the foil device can be transferred into a rest and/or starting position.

Preferably, the propulsion device and the control unit are configured for in particular automatic thrust control, further in particular for automatic thrust vector control. In this way, an additional control option is made available to a user, so that, for example, particularly tight curves can be negotiated or even jumps can be made.

In an automated configuration, active self-stabilization of the water sports apparatus is provided, in particular in the operating position, in connection with in particular position sensors such as gyrometers. In the case of active self-stabilization, the control unit thus compensates for instabilities by sending control commands to at least one actuator of the water sports apparatus, wherein actuators are active actuating elements. Here, a motor of the propulsion device, adjustable flaps or nozzles, or adjustable fins, rudders, foils, or individual adjustable portions thereof, may be involved. In the control unit, input variables such as data concerning the position of the water sports apparatus, power of the propulsion device, speed, acceleration, and/or user inputs are evaluated and control commands for one or more actuators are generated. In this way, it is possible for beginners in particular to have a better riding experience sooner. In particular, the control unit is configured for active self-stabilization of the water sports apparatus by means of thrust vector control during the transition into the operating position and/or when the float body lifts off from the water surface, since the user is subjected to great influences during these phases.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
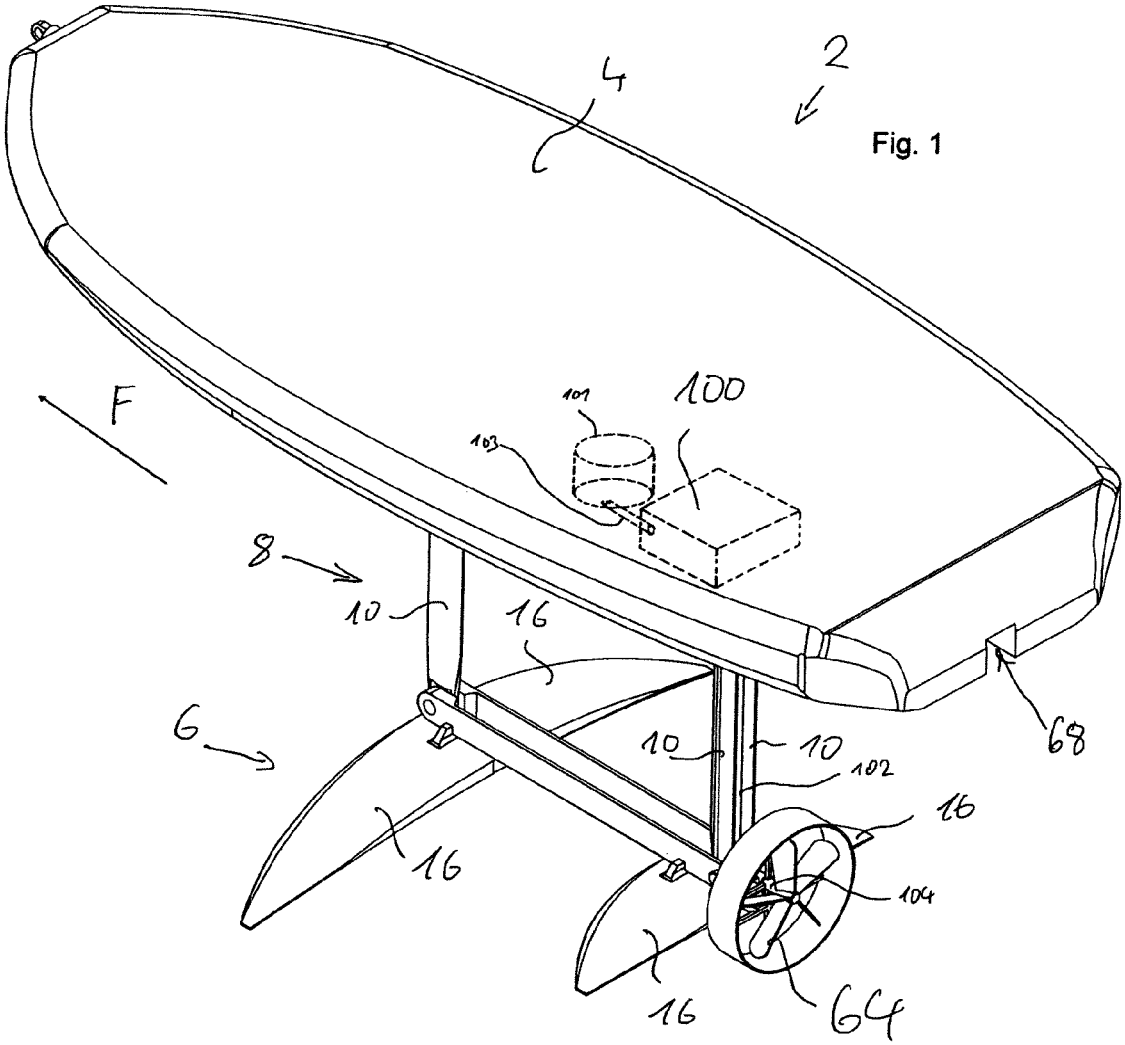
FIG. 1 shows a first article according to the invention in a perspective view.

Individual technical features of the exemplary embodiments described below may also result, in combination with the features of the independent claim, to refinements according to the invention. Where expedient, functionally identical parts are denoted by identical reference signs.

A water sports apparatus 2 according to the invention, in the form of a foilboard in the present case, has a float body 4 which is connected via a holding device 8 comprising a link 10 to a foil device 6 having foils 16. The two foils 16 of the foil device 6 generate lift during riding, which lift, for a sufficiently high speed and correspondingly fast riding in a direction F, results in the float body 4 lifting out of the water and consequently in the foilboard gliding with little water resistance. In the illustrated operating position, as well as in an rest and/or starting position of the foil device 6 close to the float body 4, the rear links 10 are situated in a recess 68 of the float body 4, for example.

A propulsion device has a motor 100 (indicated only by dashed lines due to being arranged in the interior of the float body), which, together with a propulsion element in the form of a propeller 64, is part of a propulsion device. The motor 100 is connected to a propeller 64 via a propulsion train, which is of angularly movable form and in the present case is in the form of an articulated-shaft combination. The articulated-shaft combination comprises an articulated shaft 102, which in FIG. 1 extends parallel to the two rear links 10 and is connected via two cardan joints 106 to a propeller shaft 104.

Via a supply line 103, the motor is supplied with drive energy from a propulsion energy store 101, which may for example be an accumulator or a liquefied-gas store.

Figure 2:
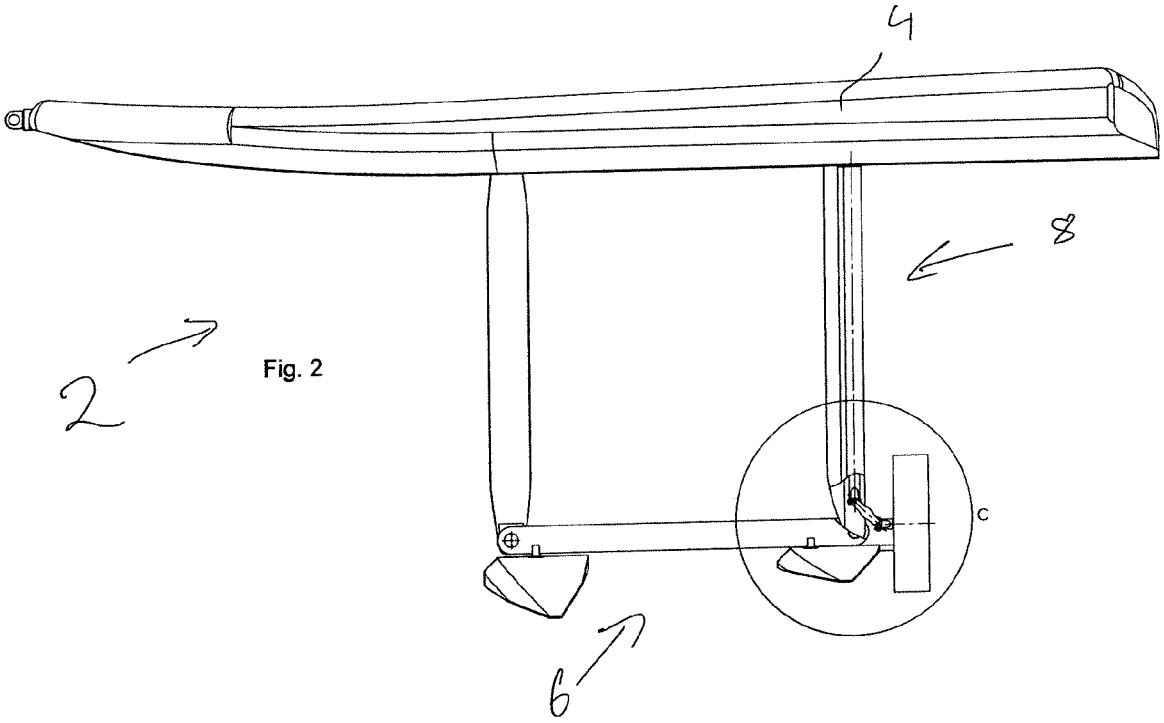
FIG. 2 shows the article in FIG. 1 in a side view.
Figure 3:
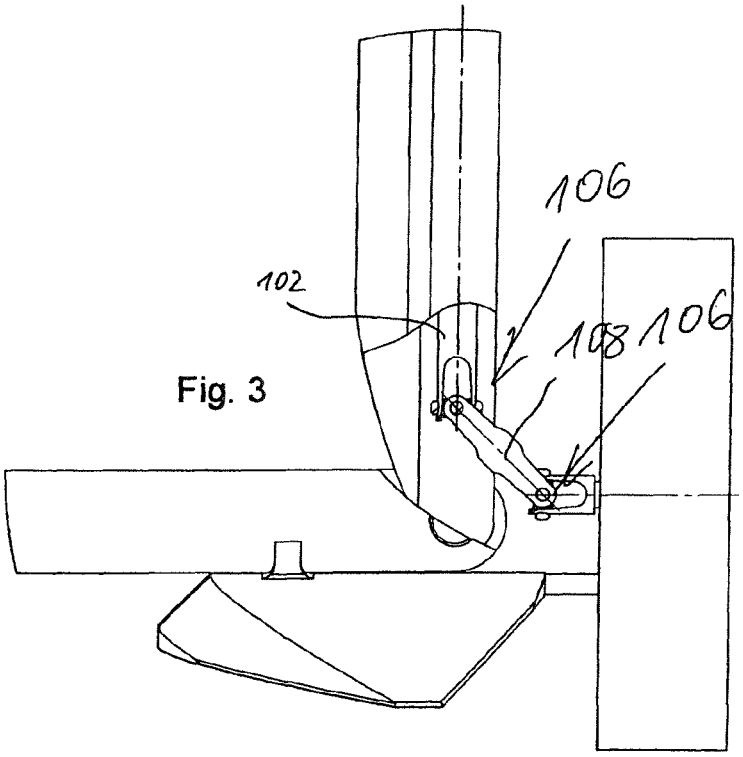
FIG. 3 shows the detail C of the article in FIG. 2 in a partially cut-away view.

In a variant of the bearing (not illustrated in any more detail), at least one of the three shafts 102, 108 and 104 is longitudinally movable, for example by means of a prismatic joint, in order to avoid a blockage for the case in which the foil device 6 is transferred into the rest and/or starting position situated close to the float body 4. Instead of longitudinal displaceability by way of a corresponding displaceable portion of the respective shaft, the shafts, in the present case, can be pivoted from their shown position, whereby a change in the shaft length is avoided (cf. also FIGS. 2 and 3). Similarly to the situation in the transition between holding device 8 and foil device 6, on the float-body side, the propulsion train may form, with cardan joints, an angularly movable transition to the propulsion shaft of a motor. Furthermore, said transition may alternatively or additionally be (if appropriate concomitantly) formed by way of constant-velocity joints.

For the purpose of avoiding injuries and fouling, the region in which the propulsion train moves may also be at least partially encapsulated.

Figure 4:
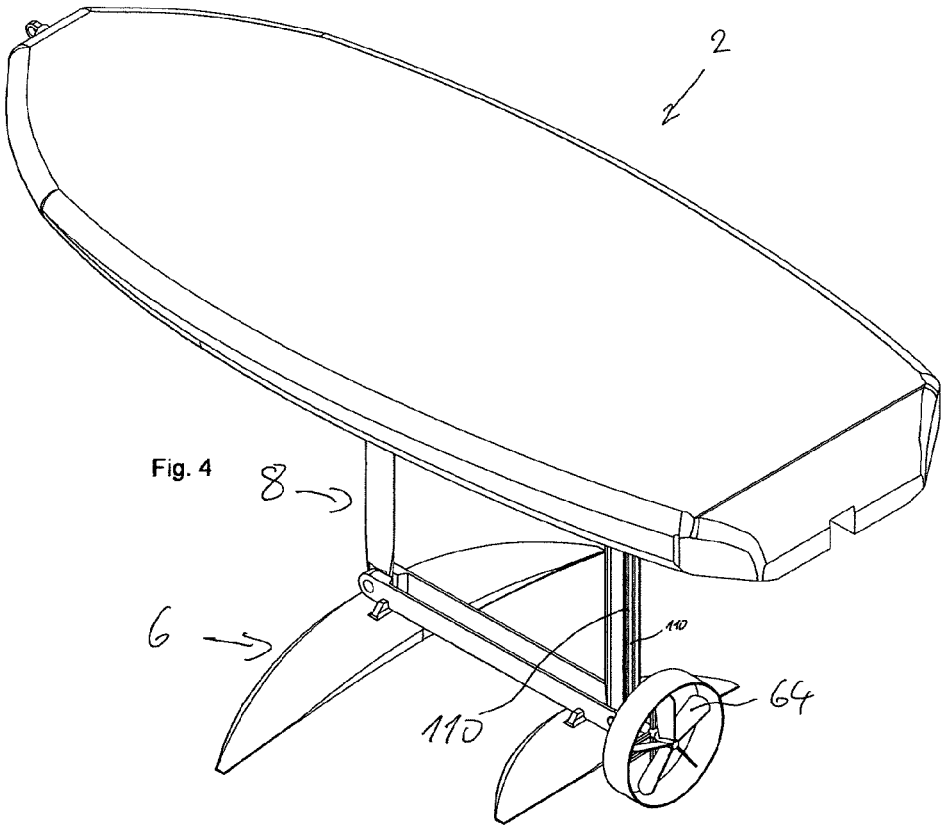
FIG. 4 shows a further article according to the invention.
Figure 5:
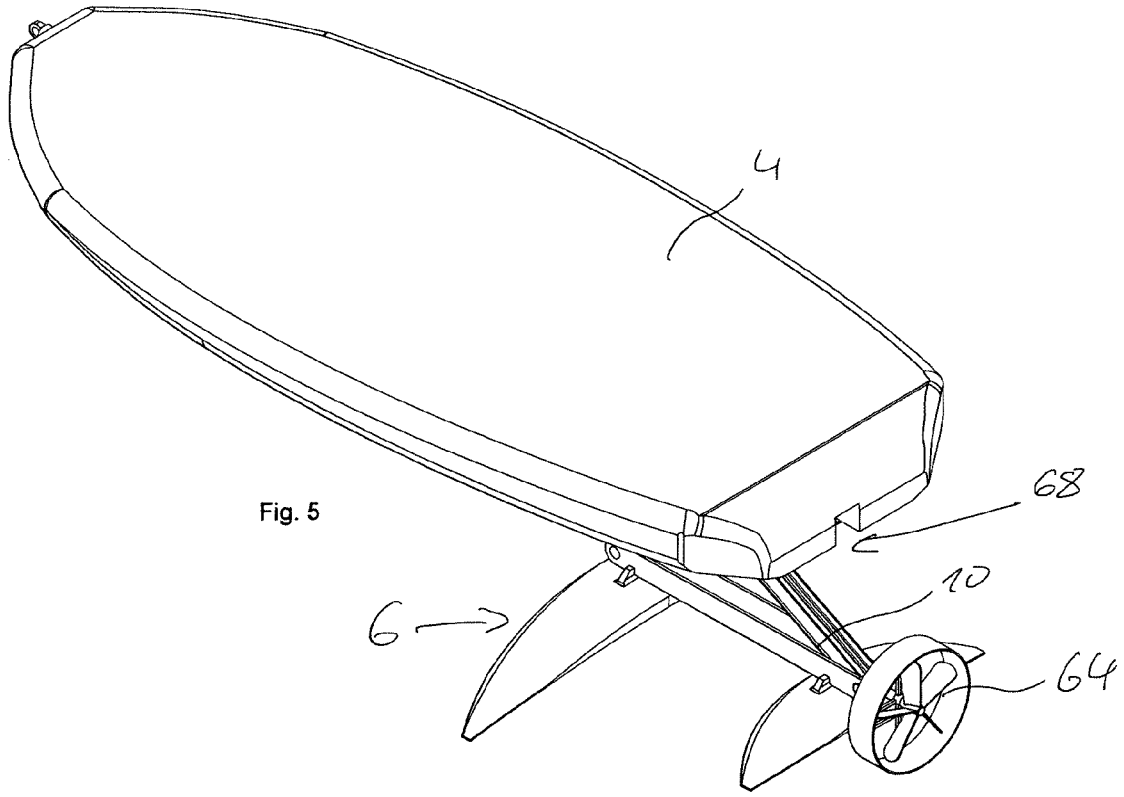
FIG. 5 shows the article in FIG. 4 in a further operating position.
Figure 6:
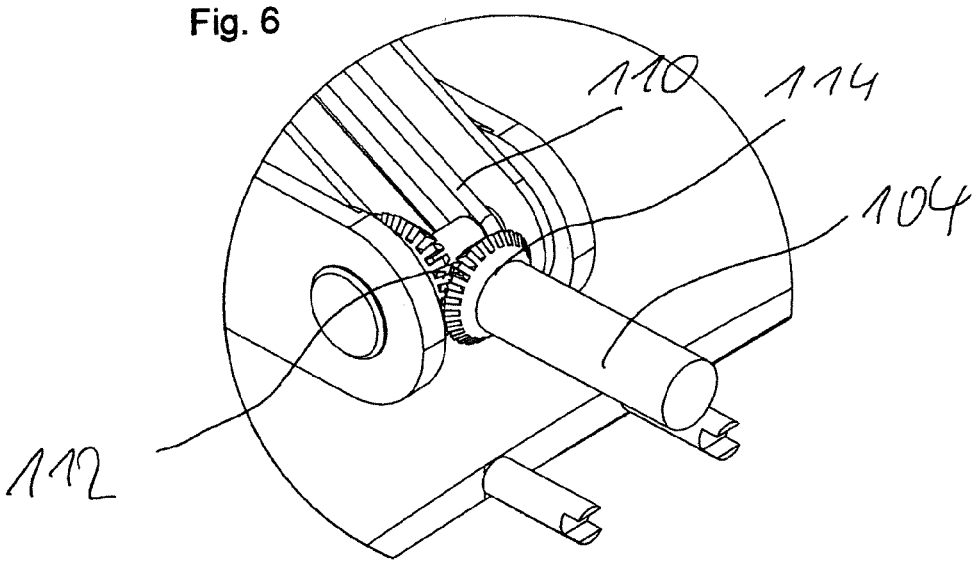
FIG. 6 shows a detail of the article in FIG. 5.

FIG. 4 discloses a further exemplary embodiment according to the invention of a water sports apparatus 2, which has an alternatively formed propulsion train. Instead of an articulated-shaft connection, a belt 110 of a belt drive transmits the force from a motor to the propeller 64. In the region of the foil device 6, the belt 110 (cf. FIG. 6) drives a bevel-gear shaft with a bevel gear 112, which acts on a bevel gear 114 seated on the propeller shaft 104. An identically acting construction is present at the float-body-side connection between the belt 110 and the motor shaft. Through the use of bevel gears which roll on one another, pivoting of the foil device 6 into a rest and starting position, in which the link 10 is arranged in the recess 68, via the intermediate position shown in FIG. 5 results in the propeller 64 being able to provide for propulsion both in one position and in the other position of the propeller 64. Thus, with the water sports apparatus according to the invention, in all the illustrated variants, starting and riding are already possible close to the beach and in shallow water, while it is then the case, during transition into deeper water and simultaneous riding, that the foil device 6 can be transferred into the operating position shown in FIG. 4.

Figure 7:
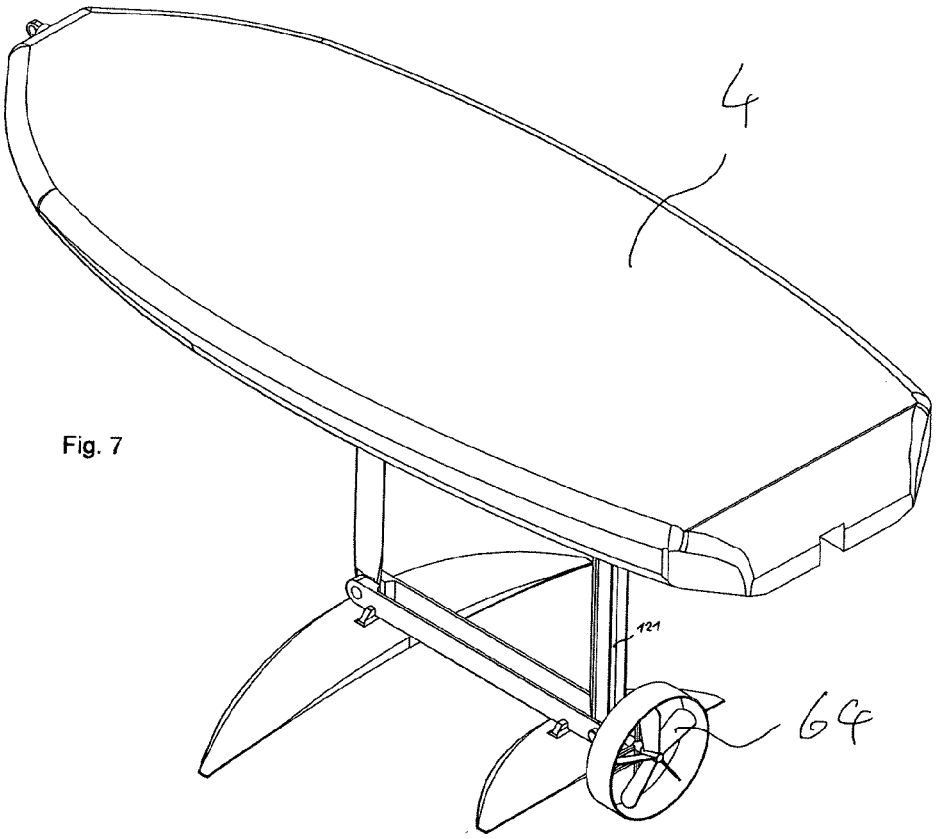
FIG. 7 shows a further article according to the invention in a perspective view.
Figure 8:
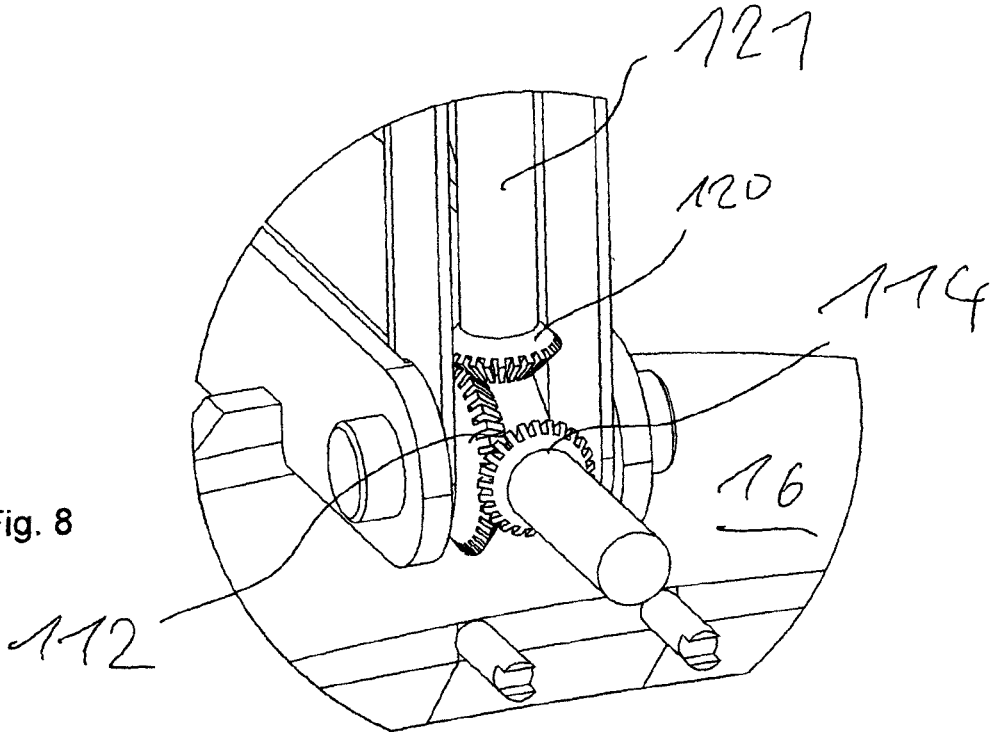
FIG. 8 shows a detail of the article in FIG. 7.
Figure 9:
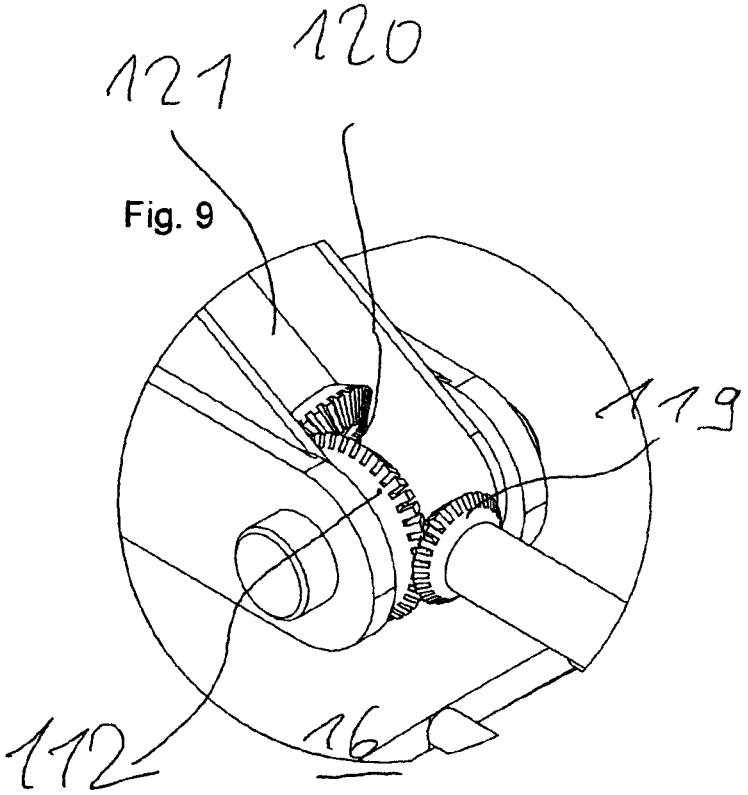
FIG. 9 shows the article in FIG. 8 in a further position of the holding device.

Instead of a belt drive with at least one circulating belt 110, in the exemplary embodiment in FIGS. 7 to 9, use is made along the links 10 of a shaft 121 provided with bevel gears 120. Only the lower bevel gear 120 can be seen by way of example in FIG. 8, while the upper one is concealed by the float body 4. During pivoting from the position illustrated in FIG. 7 into a position analogous to that in FIG. 5, the bevel gear 120 meshes continuously with the bevel gear 112. The same applies to the transition from the bevel gear 112 to the bevel gear 114, so that, in this exemplary embodiment too, it is possible for drive energy to be directed to the propeller 64 both in the position shown in FIG. 8 and in the position shown in FIG. 9 of the foil device.

The invention claimed is:

1. A water sports apparatus comprising:

a float body;

a foil device which is fastened to the float body by means of a holding device, a propulsion device which is provided for the propulsion of the water sports apparatus, the propulsion device having a motor arranged on the float-body side and connected in terms of drive to at least one propulsion element via an angularly and/or longitudinally movable propulsion train;

at least one distance sensor, said at least one distance sensor including at least one of an echo sounder sensor and a sonar sensor;

wherein the foil device, which is arranged on a link of the holding device, has one or more foils and, via the holding device, can be transferred from a rest and/or starting position close to the float body into an operating position below the float body, wherein, in the operating position and during a forward movement, on account of lift generated by the foil device, the float body can be transferred into a position in which it is spaced apart from a water surface, wherein the propulsion device is configured for thrust control, and the water sports apparatus has a control unit provided for this purpose, and wherein the control unit is configured for self-stabilization of the water sports apparatus by means of thrust vector control of the propulsion device.

2. The water sports apparatus as claimed in claim 1, wherein the propulsion train extends through or along said link of the holding device.

3. The water sports apparatus as claimed in claim 1, wherein the propulsion element is part of the foil device and/or of the holding device.

4. The water sports apparatus as claimed in claim 1, wherein the propulsion train has at least one constant-velocity joint.

5. The water sports apparatus as claimed in claim 1, wherein the propulsion train has at least one cardan joint.

6. The water sports apparatus as claimed in claim 1, wherein the propulsion train has at least one electromagnetic coupling and/or at least one bevel-gear set.

7. The water sports apparatus as claimed in claim 1, wherein the propulsion train has at least one belt drive.

8. The water sports apparatus as claimed in claim 1, wherein both in a rest and/or starting position of the foil device close to the float body and in an operating position remote therefrom, the propulsion element is connected in terms of drive to the motor and can be driven by the latter.

9. The water sports apparatus as claimed in claim 1, further including an energy store for the propulsion device, which energy store is arranged in the float body.

10. The water sports apparatus as claimed in claim 1, wherein the holding device has a drive which is provided with the or a further energy store and via which the foil device can be transferred from a rest and/or starting position into the operating position and/or from the operating position into the rest and/or starting position.

11. The water sports apparatus as claimed in claim 1, further including at least one sensor from a group comprising gyro sensors, speed sensors, position sensors, infrared sensors, and inclination sensors.

12. The water sports apparatus as claimed in claim 11, wherein the water sports apparatus has a sensor arrangement, which can be used for determination of position, and a control unit, which is configured for generating control signals on the basis of signals of the sensor arrangement for the purpose of geofencing.

13. The water sports apparatus as claimed in claim 11, wherein said position sensors include at least one of GPS sensors, Glonass sensors, and BeiDou sensors.

* * * * *